US006372704B2

(12) United States Patent
Shikata et al.

(10) Patent No.: US 6,372,704 B2
(45) **Date of Patent: *Apr. 16, 2002**

(54) DETERGENT COMPOSITION

(75) Inventors: Shitsuw Shikata; Masafumi Nomura; Toshihiro Oki; Hitoshi Tanimoto; Tsutomu Tokumoto; Nobuyuki Ogura, all of Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/734,006

(22) Filed: Dec. 12, 2000

Related U.S. Application Data

(62) Division of application No. 09/527,264, filed on Mar. 17, 2000, now Pat. No. 6,197,740.

(30) Foreign Application Priority Data

Mar. 17, 1999 (JP) ..... 11-071493

(51) Int. Cl.[7] ..... C11D 3/00

(52) U.S. Cl. ..... 510/392; 510/305; 510/306; 510/307; 510/320; 510/321; 510/357; 510/392; 510/530

(58) Field of Search ..... 510/392, 320, 510/321, 530, 305, 307, 306, 357

(56) References Cited

U.S. PATENT DOCUMENTS

| | | | | |
|---|---|---|---|---|
| 5,891,836 | A | 4/1999 | Kacher et al. | |
| 5,912,218 | A | 6/1999 | Chatterjee et al. | |
| 6,071,871 | A | 6/2000 | Gooselink et al. | |
| 6,197,740 | B1 * | 3/2001 | Shikata et al. | 510/392 |

FOREIGN PATENT DOCUMENTS

| | | |
|---|---|---|
| EP | 0878535 | 11/1998 |
| JP | 6268898 | 3/1987 |
| JP | 1501486 | 5/1989 |
| WO | WO9918218 | 4/1999 |

* cited by examiner

*Primary Examiner*—Yogendra N. Gupta
*Assistant Examiner*—Eisa Elhilo
(74) *Attorney, Agent, or Firm*—Birch, Stewart, Kolasch & Birch, LLP

(57) ABSTRACT

The present invention provides a detergent composition which is excellent in enzyme stability and exhibits excellent detergency particularly to protein-related dirt of socks and other items even under laundering conditions at a lower temperature. That is, the present invention provides a detergent composition comprising specific proportions of (a) an anionic surfactant, (b) a chlorine scavenger, (c) a protease whose α-keratin-hydrolyzing activity at 10° C. is not less than $0.09\times10^{-3}$ μg/mPU·min and (d) a protease whose α-keratin-hydrolyzing activity at 10° C. is less than $0.09\times10^{-3}$ μg/mPU·min.

11 Claims, No Drawings

DETERGENT COMPOSITION

This application is a divisional of application Ser. No. 09/527,264, filed on Mar. 17, 2000 U.S. Pat. No. 6,197,740, the entire contents of which are hereby incorporated by reference.

TECHNICAL FIELD

The present invention relates to a detergent composition.

PRIOR ART

Incorporating an enzyme into a detergent composition has been practiced, and, for example, JP-A 1-501486 discloses a detergent composition using two or more specific kinds of proteases. However, since enzymatic activity is lowered under the laundering condition at a low temperature, a satisfactory washing-performance cannot be obtained and this problem is particularly remarkable in protein-related dirt of soiled socks, necks, and so on. Although JP-A 62-68898 discloses a detergent composition in which enzyme is stabilized by a sulfite, this composition does not satisfactorily solve the two problems of enzyme deactivation and washing-performance at a low temperature, either.

DISCLOSURE OF THE INVENTION

The object of the present invention is to provide a detergent composition which is almost free from enzyme deactivation, which is excellent in detergency under laundering conditions at a lower temperature, and which is effective particularly for protein-related dirt (of) on soiled socks and other items.

The present invention provides a detergent composition comprising (a) 15 to 40% by weight of an anionic surfactant, (b) 0.5 to 5% by weight of a chlorine scavenger, (c) a protease whose α-keratin-hydrolyzing activity at 10° C. is not less than $0.09\times10^{-3}$ μg/mPU·min and (d) a protease whose α-keratin-hydrolyzing activity at 10° C. is less than $0.09\times10^{-3}$ μg/mPU·min, wherein (c)+(d)=0.01 to 0.5% by weight (as powdered enzyme product), (c)/(d)=1/5 to 5/1 and [(c)+(d)]/(b)=1/100 to 1/2 (weight ratio as powdered enzyme product).

Herein, the term "enzyme powder" means the enzyme product powdered by lyophilizing the supernatant of the fermenter broth concentrated by ultrafiltration.

MODE FOR CARRYING OUT THE INVENTION

An anionic surfactant is the "(a)" component in the present invention. Examples of the anionic surfactant include an alkylbenzenesulfonate, an alkylsulfate, an alkylethersulfate, an olefinsulfonate, an alkanesulfonate, a fatty acid salt, an alkyl or alkenyl ether carboxylate and an α-sulfofatty acid salt or an ester thereof. Among them, an alkylbenzenesulfonate whose alkyl group has 10 to 20 carbon atoms, an alkylsulfate having 8 to 18 (preferably 10 to 14) carbon atoms, an alkylethersulfate having 8 to 18 (preferably 10 to 14) carbon atoms, and a fatty acid salt being derived from palm oil or tallow and having 8 to 18 (preferably 10 to 18) carbon atoms, are preferable. The average molar number of ethylene oxide added in the alkylethersulfate is preferably 1 to 20, more preferably 1 to 10 and particularly preferably 1 to 5. As the salts, a salt of an alkaline metal such as sodium and potassium is preferable. The incorporated amount of the "(a)" component is 15 to 40% by weight, preferably 20 to 40% by weight, in the composition from the standpoint of detergency and foaming property.

In the present invention, in order to prevent the enzyme from being deactivated by chlorine which is present in water, a chlorine scavenger is the "(b)" component. Specific examples of the scavenger include an amine such as a primary amine, a secondary amine and an alkanol amine; an inorganic peroxide such as hydrogen peroxide, sodium percarbonate and sodium perborate; a reducing agent such as a sulfite. Among them, a sulfite is preferable from the standpoint of stability in the composition and enzyme-stabilizing effect in a laundering bath. From standpoint of the stability of enzyme, the "(b)" component is incorporated in an amount of 0.5 to 5% by weight, preferably 0.5 to 2% by weight, in the composition.

A protease, whose α-keratin-hydrolyzing activity at 10° C. is not less than $0.09\times10^{-3}$ μg/mPU·min, preferably not less than $0.10\times10^{-3}$ μg/mPU·min, more preferably not less than $0.12\times10^{-3}$ μg/mPU·min and furthermore preferably not less than $0.13\times10^{-3}$ μg/mPU·min and whose α-keratin-hydrolyzing activity at 30° C. is preferably not less than $0.40\times10^{-3}$ μg/mPU·min, more preferably not less than $0.44\times10^{-3}$ μg/mPU·min and furthermore preferably not less than $0.47\times10^{-3}$ μg/mPU·min, is used as the "(c)" component in the present invention.

In addition, a protease, whose α-keratin-hydrolyzing activity at 10° C. is less than $0.09\times10^{-3}$ μg/mPU·min and preferably less than $0.07\times10^{-3}$ μg/mPU·min and whose α-keratin-hydrolyzing activity at 30° C. is preferably less than $0.40\times10^{-3}$ μg/mPU·min, more preferably less than $0.35\times10^{-3}$ μg/mPU·min, furthermore preferably less than $0.30\times10^{-3}$ μg/mPU·min and particularly preferably less than $0.20\times10^{-3}$ μg/mPU·min, is used as the "(d)" component.

Here, the α-keratin-hydrolyzing activity was expressed as a soluble material (calculated as based on tyrosine) formed from α-keratin for 1 minute per casein hydrolyzing activity of 1 mPU shown in the following (ii). That is, the α-keratin-hydrolyzing activity was measured according to the following (i) to (iii) methods.

(i) Preparation of α-keratin

A part of skin of human heel (horny layer) was cut off with a surgical knife, and, after being cut into pieces with a pair of scissors, washed with distilled water. One gram of this horny skin was suspended in 20 to 50 ml of a 50 mM Tris-HCl buffer (pH: 8.0) containing 8 M of urea and 25 mM of β-mercaptoethanol, and stirred overnight. The swollen horny skin was sufficiently ground by a TEFLON HOMOGENIZER™ and subjected to centrifugal separation at 30,000×g for 30 minutes. The supernatant liquid obtained by the centrifugal separation was filtered through a filter paper (No.2 supplied by Whatman International Ltd.). The filtrate underwent dialysis to a 50 mM Tris-HCl buffer (pH: 8.0) and was then subjected to centrifugal separation at 100,000×g for 2 hours. The precipitate obtained was dissolved in a 50 mM Tris-HCl buffer (pH: 8.0) containing 8 M of urea and 25 mM of β-mercaptoethanol. The solution thus obtained again underwent dialysis to a 50 mM Tris-HCl buffer (pH: 8.0) and was then subjected to centrifugal separation at 100,000×g for 2 hours. After the supernatant liquid was removed, the precipitate was dissolved in a 50 mM Tris-HCl buffer (pH: 8.0) containing 8 M of urea and 25 mM of β-mercaptoethanol. The solution thus obtained underwent dialysis to distilled water and was pulverized to prepare powder after lyophilizing. The powder product was used as α-keratin.

(ii) Measurement of Casein-hydrolyzing Activity

After 1 ml of a 50 mM boric acid buffer (pH: 10.5) containing 1% (w/v) of casein (Hammarsten, supplied by Merck) was held at 30° C. for 5 minutes, 0.1 ml of an enzyme solution was added and incubated at 30° C. for 15 minutes. Next, 2 ml of a TCA solution (0.11 M trichloroacetic acid, 0.22 M sodium acetate and 0.33 M acetic acid) was added thereto. After the resulting solution was left to stand for 10 minutes at room temperature, the acid-denatured protein was eliminated by filtration and the acid-soluble peptides contained in the filtrate were quantified by the Lowry method. That is, 2.5 ml of an alkaline copper solution [a 1:1:100 (v/v) mixture of a 1%(w/v) potassium sodium tartrate aqueous solution, a 1%(w/v) copper sulfate aqueous solution, and a solution prepared by dissolving sodium carbonate in a 0.1 M sodium hydroxide aqueous solution (sodium carbonate concentration: 2% (w/v))] was added to 0.5 ml of the filtrate. After the resulting solution was kept at 30° C. for 10 minutes, 0.25 ml of a diluted phenol reagent (obtained by 2-fold dilution of folin-ciocalteu's phenol reagent with distilled water) was further added. Then, after the resulting solution was kept at 30° C. for 30 minutes, the absorbance at 660 nm was measured. Meanwhile, the result, obtained by adding the enzyme solution after adding the TCA solution and being left to stand for 10 minutes at room temperature, was determined as a blank. The 100 PU of enzyme was defined as the amount of enzyme that produced acid-soluble peptides being equivalent to one micromole of L-tyrosine per minute.

(iii) Measurement of α-keratin Hydrolyzing Activity 2 mg of α-keratin and 0.9 ml of a 50 mM boric acid buffer (pH: 10.5) were placed in a test tube and the resultant mixture was held at 10° C. or 30° C. for 10 minutes. Then, 0.1 ml of a protease solution was added thereto and mixed so that the casein hydrolyzing activity shown in (ii) mentioned above was $10^5$mPU. After being incubated for 30 minutes for calculating α-keratin hydrolyzing activity at 10° C. or for 10 minutes for calculating α-keratin hydrolyzing activity at 30° C., the reaction mixture was filtered. The solubilized peptides contained in the filtrate were quantified by the Lowry method and the α-keratin hydrolyzing activity was measured.

Examples of the protease as the "(c)" component include a protease produced from a microorganism deposited in the National Institute of Bioscience and Human-Technology, Agency of Industrial Science and Technology, as Bacillus sp. KSM-KP 43 (FERM BP-6532), Bacillus sp. KSM-KP 1790 (FERM BP-6533), Bacillus sp. KSM-KP 9860 (FERM BP-6534) (date of original deposition: Sep. 18, 1996) and a mutant thereof as well as a protease produced from the transformant having a gene coding the enzymes. In particular, Bacillus sp. KSM-KP 43 and a mutant thereof are excellent.

Examples of the protease as (d) component include ALCALASE®, SAVINASE®, DURAZYM® and EVERLASE® (all supplied by Novo Nordisk A/S), PURAFECT® and MAXAPEM® (all supplied by Genencor International) and KAP (supplied by Kao Corp.). In particular, KAP 4.3 G and KAP 11.1 G are excellent.

In the present invention, from the standpoint of detergency at a low temperature, the sum of the components (c) and (d) is 0.01 to 0.5% by weight, preferably 0.02 to 0.3% by weight, as powdered enzyme product. Further, from the standpoint of detergency to dirt derived from horny skin (keratin) or sebum, the weight ratio as powdered enzyme product of the both components, i.e. (c)/(d), is 1/5 to 5/1, preferably 1/5 to 2/1, and more preferably 1/4 to 2/1. Furthermore, from the standpoint of enzyme stability in a laundering bath, [(c)+(d)]/(b)=1/100 to 1/2 and preferably 1/80 to 1/3 (weight ratio as powdered enzyme product).

It is desirable that the composition of the present invention further contains a polyoxyalkylene alkyl or alkenyl ether whose HLB (Griffin's method) is 11.5 to 17, preferably 12 to 16, from the standpoint of enzyme stability in a laundering bath. Here, the alkyl group or the alkenyl group has favorably 10 to 18, favorably preferably 10 to 16, carbon atoms. The oxyalkylene group is preferably an oxyethylene group. The incorporated amount of the compound is 0 to 15% by weight and preferably 0.5 to 10% by weight in the composition.

Further, a percarbonate may be incorporated in the composition of the present invention to impart a bleaching effect. Although examples of the percarbonate as salt include a salt of an alkaline metal such as sodium and potassium, an ammonium salt and an alkanol amine salt, a sodium salt is preferable. Further, from the standpoint of the stability of the percarbonate, it is preferable to be a percarbonate coated with one or more compounds selected from, for example, paraffin, a (per)borate, an ethylene oxide adduct of an alcohol, polyethylene glycol and a silicic acid-based compound. In addition, in order to further promote the bleaching effect, a bleaching activator represented by the following formula (I) or (II) may be incorporated in the composition of the present invention.

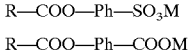

$$R—COO—Ph—SO_3M \quad (I)$$

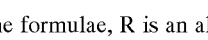

$$R—COO—Ph—COOM \quad (II)$$

[In the formulae, R is an alkyl or alkenyl group having 5 to 13 carbon atoms, Ph is a phenyl group and M is selected from a hydrogen atom, an alkaline metal, an alkaline earth metal and ammonium.]

In particular, it is preferable to be a bleaching activator represented by the following formula (I), in which R is an alkyl group having 11 to 13 carbon atoms and M is an alkaline metal such as sodium.

From the standpoint of bleaching effect, the composition of the present invention preferably contains 0.1 to 10% by weight, 0.5 to 5% by weight in particular, of a percarbonate and 0.1 to 5% by weight, 0.5 to 3% by weight in particular, of a bleaching activator.

In the present invention, the detergency can be further improved by use of an alkaline cellulose which is produced from analkalophilic microorganism, e.g. Bacillus sp. KSM-635 (FERM BP-1485), or a mutant thereof. This alkaline cellulase has an optimum pH value of 7 or more when carboxymethyl cellulose is used as a substrate or has a relative activity of 50% or more at a pH value of 8 or more with respect to the optimum condition. A specific example of the alkaline cellulase is KAC 500 (registered trademark) which is supplied by Kao corp. and which is an enzyme granulation product. The composition of the present invention preferably contains this alkaline cellulase in an amount of 0.001 to 5% by weight, 0.1 to 3% by weight in particular, as the enzyme granulation product containing 0.1 to 50% by weight of the powdered enzyme product.

In the present invention, besides the above-mentioned anionic surfactant and the nonionic surfactants, an amphoteric surfactant such as an amine oxide, a sulfobetaine and a carbobetaine or a cationic surfactant such as a quaternary ammonium salt may be incorporated, if necessary.

The composition of the present invention may contain a crystalline alumino-silicate such as zeolite A, X and P in order to heighten the detergency. In particular, zeolite A is preferable. The average diameter of primary particles is preferably 0.1 to 10 μm and particularly preferably 0.1 to 5 μm. The incorporated amount is preferably 5 to 40% by weight, more preferably 10 to 40% by weight, in the composition.

The detergent composition of the present invention may contain, for example, 0.01 to 10% by weight of an enzyme such as lipase and amylase, 1 to 50% by weight of an alkaline agent and/or an inorganic electrolyte such as a silicate, a carbonate and a sulfate, and 0.01 to 10% by weight of an antiredeposition agent such as polyethylene glycol, polyvinyl alcohol, polyvinylpyrrolidone and CMC.

EXAMPLES

Detergent compositions shown in Table 1 were prepared and the following evaluations were carried out.

[Evaluation of Detergency]

① Detergency to Collars Soiled with Dirt

Five cotton shirts, which had been worn by males in their thirties for 3 days and the collar areas of which were similarly soiled with dirt, were selected and subjected to experiments. The 5 shirts mentioned above were washed at the temperatures of 10° C. and 30° C. in water according to a standard course of a laundering machine (Laundering Machine Model NA-F60E supplied by National) using 20 g of the composition shown in Table 1. After dehydration and air drying, the detergency to the collar area was evaluated by 10 trained panelists according to the following criteria and the average marks were determined.

1: Dirt was removed to a satisfactory level.

2: Dirt remained but the level of dirt was insignificant.

3: Dirt remained and the level of dirt was noticeable.

4: A fairly large proportion of dirt remained.

② Detergency to Socks Soiled with Dirt

White socks (supplied by Gunze Co., Ltd., Support & Clean, made of cotton acryl polyester polyurethane) were worn by 5-year-old and 6-year-old boys for 1 day. Five socks, which were similarly soiled with dirt, were selected and subjected to experiments. The socks were washed and evaluated in the same way as in the experiments of the above-mentioned detergency to collars soiled with dirt.

[Stability of Protease in a Laundering Bath]

0.667 g of the composition of Table 1 and 1 L of tap water at 20° C. (the chlorine concentration of the tap water was confirmed to be 0.8 ppm by titration with N/100 sodium permanganate) were placed in a 1 L glass beaker (having a height of 150 mm and an inner diameter of 100 mm) and stirred (200 rpm) by a magnetic stirrer (having a total length of 43 mm and a diameter of 13 mm) for 1 minute in a constant temperature bath at 20° C. 0.1 mL of this resulting solution was taken out and subjected to measuring of the casein hydrolyzing activity as described above. Next, after 20 minutes from the starting of stirring, 0.1 mL of the solution was taken out again and subjected to measuring of the casein hydrolyzing activity. The stability of protease was determined according to the following formula.

$$\text{Stability of protease (\%)} = \frac{\text{Casein hydrolyzing activity after 20 minutes}}{\text{Casein hydrolyzing activity after 1 minute}} \times 100$$

TABLE 1

| | | | Examples | | | Comparative examples | | | |
|---|---|---|---|---|---|---|---|---|---|
| | | | 1 | 2 | 3 | 1 | 2 | 3 | 4 |
| Detergent composition (% by weight) | A-1 | | 20 | 20 | 23 | 20 | 20 | 20 | 20 |
| | A-2 | | 5 | 5 | 7 | 5 | 5 | 5 | 5 |
| | A-3 | | 5 | 5 | 5 | 5 | 5 | 5 | 5 |
| | B-1 | | 1 | 1 | 1 | | 1 | 1 | 0.15 |
| | C-1 | | 0.3 | 0.4 | 0.4 | 0.3 | | 0.8 | 0.05 |
| | D-1 | | 0.5 | 0.4 | 0.4 | 0.5 | 0.8 | | 0.75 |
| | E-1 | | 5 | 5 | | 5 | 5 | 5 | 5 |
| | F-1 | | | 3 | | | | | |
| | G-1 | | | 2 | | | | | |
| | H-1 | | 0.5 | 0.5 | 0.5 | 0.5 | 0.5 | 0.5 | 0.5 |
| | I-1 | | 5 | 5 | 5 | 5 | 5 | 5 | 5 |
| | J-1 | | 25 | 25 | 25 | 25 | 25 | 25 | 25 |
| | K-1 | | 0.1 | 0.1 | 0.1 | 0.1 | 0.1 | 0.1 | 0.1 |
| | Sodium carbonate | | 10 | 10 | 10 | 10 | 10 | 10 | 10 |
| | Sodium sulfate | | 5 | 5 | 5 | 5 | 5 | 5 | 5 |
| | Silicate No. 1 | | 10 | 10 | 10 | 10 | 10 | 10 | 10 |
| | Water content | | Balance | Balance | Balance | Balance | Balance | Balance | Balance |
| | Total amount (% by weight) | | 100 | 100 | 100 | 100 | 100 | 100 | 100 |
| Ratio of [(c)/(d)] by weight | | | 6/5 | 2/1 | 2/1 | 6/5 | — | — | 13/100 |
| Ratio of [(c) + (d)]/(b) by weight | | | 11/100 | 12/100 | 12/100 | — | 8/100 | 16/100 | 17/30 |
| Evaulation of performance | dirt on collar | 10° C. | 1.8 | 1.5 | 1.9 | 2.4 | 2.5 | 2.2 | 2.5 |
| | | 30° C. | 1.4 | 1.1 | 1.7 | 2.1 | 1.9 | 2.1 | 2.1 |
| | dirt on socks | 10° C. | 2 | 1.8 | 2 | 2.6 | 2.7 | 2.4 | 2.5 |
| | | 30° C. | 1.7 | 1.4 | 1.8 | 2.3 | 2.3 | 2.3 | 2.3 |
| Stability of protease (%) | | | 97 | 95 | 90 | 65 | 92 | 90 | 85 |

(Note) The components in Table 1 are as follows.

A-1: sodium linear alkyl (having 12 to 14 carbon atoms) benzenesulfonate

A-2: sodium alkylsulfate (EMAL 10 Powder supplied by Kao Corp.)

A-3: myristic acid

B-1: sodium sulfite

C-1: The protease (α-keratin-hydrolyzing activity at 10° C.: $0.14\times10^{-3}$ μg/mPU·min and α-keratin-hydrolyzing activity at 30° C.: $0.49\times10^{-3}$ μg/mPU·min) produced from Bacillus sp. KSM-KP 43 was granulated according to JP-A 62-257990. The enzyme content in the enzyme granulation product was 20% by weight as the powdered enzyme product.

D-1: KAP 4.3 G (supplied by Kao Corp., α-keratin-hydrolyzing activity at 10° C.: $0.05\times10^{-3}$ μg/mPU·min and α-keratin-hydrolyzing activity at 30° C.: $0.11\times10^{-3}$ μg/mPU·min, enzyme content: 10% by weight as powdered enzyme product)

E-1: polyoxyethylene lauryl ether (average molar number of ethylene oxide added: 10, HLB by Griffin's method: 14.6)

F-1: coated sodium percarbonate (sodium percarbonate coated with sodium metaborate tetrahydrate in an amount of 5% being relative to the sodium percarbonate based on Example 1 of JP-A 59-196399)

G-1: sodium lauroyloxybenzenesulfonate

H-1: KAC 500 (alkaline cellulase supplied by Kao Corp., enzyme content: 10% by weight as powdered enzyme product)

I-1: acrylic acid-maleic acid copolymer (Sokalan cp-5 supplied by BASF)

J-1: zeolite A (average diameter of primary particles: 0.3 μm)

K-1: fluorescent brightener (PHOTINE CBUS-3B supplied by Hickson & Welch Ltd.)

In Table 1, the incorporated amounts of C-1, D-1 and H-1 are the amounts as respective enzyme granulation products.

What is claimed is:

1. A detergent composition comprising (a) 15 to 40% by weight of an anionic surfactant, (b) 0.5 to 5% by weight of a chlorine scavenger, (c) a protease whose (α-keratin-hydrolyzing activity at 10° C. is not less than $0.09\times10^{-3}$ μg/mPU·min and (d) a protease whose α-keratin-hydrolyzing activity at 10° C. is less than $0.09\times10^{-3}$ μg/mPU·min, wherein (c)+(d)=0.01 to 0.5%by weight (as powdered enzyme product), (c)/(d)=1/5 to 5/1 and ((c)+(d)/(b)=1/100 to 1/2 (weight ratio as powdered enzyme product).

2. The detergent composition as claimed in claim 1, wherein (b) chlorine scavenger is a sulfite.

3. The detergent composition as claimed in claim 1, containing a polyoxyalkylene alkyl or alkenyl ether whose HLB (Griffin's method) is 11.5 to 17.

4. The detergent composition as claimed in claim 2, containing a polyalkylene alkyl or alkenyl ether whose HLB (Griffin's method) is 11.5 to 17.

5. A detergent composition as claimed in claim 1, wherein the component (a) is present in the composition in an amount of 20 to 40% by weight.

6. A detergent composition as claimed in claim 1, wherein the component (a) anionic surfactant is selected from the group consisting of alkylbenzenesulfonate, alkylsulfate, alkylethersulfate, olefinsulfonate, alkanesulfonate, fatty acid salt, alkyl ether carboxylate, alkenyl ether carboxylate, α-sulfofatty acid salt and α-sulfofatty acid ester.

7. A detergent composition as claimed in claim 1, wherein the component (b) chlorine scavenger is present in the composition in an amount of 0.5 to 2% by weight.

8. A detergent composition as claimed in claim 1, wherein the component (b) chlorine scavenger is selected from the group consisting of an amine, an inorganic peroxide and a reducing agent.

9. A detergent composition as claimed in claim 1, wherein the component (b) chlorine scavenger is selected from the group consisting of a primary amine, a secondary amine, an alkanol amine, hydrogen peroxide, sodium percarbonate, sodium per borate, and a sulfite.

10. The detergent composition as claimed in claim 1, wherein the component (c) protease is a protease whose α-keratin-hydrolyzing activity at 30° C. is not less than $0.40\times10^{-3}$ μg/mPU·min.

11. The detergent composition as claimed in claim 1, wherein the component (d) protease is a protease whose α-keratin-hydrolyzing activity at 30° C. is less than $0.40\times10^{-3}$ μg/mPU·min.

* * * * *